US007549360B2

(12) United States Patent
Aoyama

(10) Patent No.: US 7,549,360 B2
(45) Date of Patent: Jun. 23, 2009

(54) MECHANISMS FOR DETERMINING OBLIQUELY INCLINED POSITIONS OF CUTTING DEVICES

(75) Inventor: Syuji Aoyama, Anjo (JP)

(73) Assignee: Makita Corporation, Anjo-Shi (JP)

( * ) Notice: Subject to any disclaimer, the term of this patent is extended or adjusted under 35 U.S.C. 154(b) by 555 days.

(21) Appl. No.: 11/193,475

(22) Filed: Aug. 1, 2005

(65) Prior Publication Data

US 2006/0027067 A1 Feb. 9, 2006

(30) Foreign Application Priority Data

Aug. 4, 2004 (JP) ..... 2004-227883

(51) Int. Cl.
*B26D 1/14* (2006.01)
*B27B 5/26* (2006.01)

(52) U.S. Cl. ..... 83/471.3; 83/473; 83/490; 83/522.11; 83/581

(58) Field of Classification Search ..... 83/471.3, 83/473, 490, 581, 522.11, 522.15, 522.16, 83/522.18, 522.25
See application file for complete search history.

(56) References Cited

U.S. PATENT DOCUMENTS 5,042,348 A * 8/1991 Brundage et al. ..... 83/471.3
5,392,678 A 2/1995 Sasaki et al.
5,823,085 A * 10/1998 Kondo et al. ..... 83/471.3
6,662,697 B1 12/2003 Chen
6,823,765 B2 * 11/2004 Stumpf et al. ..... 83/471.3
7,021,186 B2 * 4/2006 Brazell et al. ..... 83/471.3
7,337,702 B2 * 3/2008 Parks et al. ..... 83/471.3
2003/0150311 A1 8/2003 Carroll et al.
2004/0089125 A1 5/2004 Schoene et al.

FOREIGN PATENT DOCUMENTS

EP 0 642 896 A 3/1995
JP A 08-252802 10/1996
JP A 2003-245901 9/2003

* cited by examiner

*Primary Examiner*—Kenneth E. Peterson
*Assistant Examiner*—Phong Nguyen
(74) *Attorney, Agent, or Firm*—Oliff & Berridge, PLC

(57) ABSTRACT

An obliquely inclined position determining mechanism has an intermediate base rotatable relative to both a support base and a pivotal base of a pivotal support of a cutting device. A fixing device is operable to releasably fix the intermediate base in position relative to the support base or the pivotal base. An adjustable screw is operable to accurately determine the rotational position of the intermediate base relative to the pivotal base or the support base at least when the saw unit has been pivoted to a target obliquely inclined position.

12 Claims, 9 Drawing Sheets

MECHANISMS FOR DETERMINING OBLIQUELY INCLINED POSITIONS OF CUTTING DEVICES

This application claims priority to Japanese patent application serial number 2004-227883, the contents of which are incorporated herein by reference.

BACKGROUND OF THE INVENTION

1. Field of the Invention

The present invention relates to obliquely inclined position determining mechanisms of cutting devices and in particular to mechanisms for determining obliquely inclined positions of saw units of cutting devices, which have rotary circular saw blades for cutting workpieces such as wooden workpieces, so that a type of cutting operation referred to as an "oblique cutting operation" can be performed with the saw units or the saw blades obliquely inclined relative to the workpieces. In this specification, "inclined position" is used to mean a position inclined in a right or left direction with respect to a cutting direction, unless otherwise noted.

2. Description of the Related Art

Japanese Laid-Open Patent Publication No. 8-252802, assigned to the same assignee as the present invention, teaches an obliquely inclined position determining mechanism that is operable to position a saw blade of a saw unit in a vertical position, where the saw blade extends substantially perpendicular to an upper surface of a table, and in obliquely inclined positions, where the saw blade may be inclined by an angle of 45° in the right and left directions with respect to the cutting direction relative to the upper surface of the table.

Japanese Laid-Open Patent Publication No. 2003-245901 teaches a mechanism that is operable to determine the positions of a saw blade of a saw unit in a vertical position and a 45° inclined position in one of the right and left directions. In addition, this mechanism is operable to determine a position of the saw blade in an additional position, such as a position inclined by an angle of 5° from the 45° inclined position.

However, the determinable inclined positions of the known mechanisms are limited to the frequently used vertical position and a 45° inclined position(s). Therefore, in order to set a saw unit or a saw blade in another position, such as a position between the vertical position and the 45° inclined position, the operator is required to perform the following operations. The operator first loosens a fixing lever, which otherwise fixes the inclined position of the saw unit, so that the saw unit can freely pivot about an axis. The operator then pivots the saw unit to the desired inclined position while observing the associated angular scale. Thereafter, with the saw unit held in the desired inclined position by the operator, the operator functions to tighten the fixing lever in order to fix the saw unit in the desired inclined position.

Still, in order to accurately fix the saw unit in the desired position, it is necessary for the operator to pivot the saw unit, which may be a relatively heavy unit, by small angles in one direction and an opposite direction while the operator repeatedly loosens and tightens the fixing lever. This adjusting operation may be very troublesome. Additionally, in practice it may be very difficult to acutely position the saw unit in the desired position.

SUMMARY OF THE INVENTION

It is accordingly an object of the present invention to teach improved obliquely inclined position determining mechanisms that can effectively determine the inclined positions of a saw unit.

In one aspect of the present teachings, obliquely inclined position determining mechanisms for cutting devices are taught. The cutting devices include a saw unit having a saw blade, a table for placing a workpiece thereon, and a pivotal support for pivotally supporting the saw unit relative to the table, The pivotal support includes a support base on the side of the table and a pivotal base on the side of the saw unit, rotatably coupled to the support base about a rotational axis. The cutting device further includes a first fixing device operable to fix the pivotal base in position relative to the support base. The obliquely inclined position determining mechanisms may include a fixed obliquely inclined position determining mechanism and an intermediate obliquely inclined position determining mechanism. The fixed obliquely inclined position determining mechanism serves to limit the pivotal movement of the pivotal base relative to the support base, so that the position of the saw unit can be determined at a plurality of positions that may include at least a first position and a second position. The intermediate obliquely inclined position determining mechanism may serve to determine the pivotal position of the saw unit at a third position between the first and second positions. The intermediate obliquely inclined position determining mechanism includes an intermediate base that is rotatable, relative to the support base and the pivotal base, about the rotational axis of the pivotal base, a second fixing device operable to fix the intermediate base in position relative to one of the support base and the pivotal base, and a position determining member mounted to the intermediate base and arranged and constructed to contact with the other of the support base and the pivotal base when the saw unit has pivoted to a third position.

With the first fixing device and the second fixing device loosened in order to permit rotation of the pivotal base relative to the support base and to permit rotation of the intermediate base relative to one of the pivotal base and the support base, the position of the saw unit may be determined at the first position, e.g., a vertical position, and second position, e.g., a 45° inclined position After the position of the saw unit has been determined at the fist position or the second position, the operator may tighten the first and second fixing devices so that a cutting operation can be preformed with the saw unit positioned at the first or second position. For example, a vertical cutting operation or an oblique cutting operation can then be performed.

In order to determine the position of the saw unit at the third position or the intermediate position, the operator may loosen the first and second fixing devices. The operator may then pivot the saw unit to the third position, for example, by referencing an angular scale. With the saw unit held in the third position, the operator may rotate the intermediate base until the position determining member contacts with the other of the pivotal base and the support base. The operator may then tighten the second firing device so that the intermediate base may be fixed in position relative to one of the pivotal base and the support base. The position of the saw unit may thus be determined at the third position. As a final step, the operator may tighten the first fixing device so that the operator may perform a cutting operation with the saw unit positioned at the third position.

In order to perform the cutting operation with the saw unit positioned at the first position, e.g., the vertical position, after performing a cutting operation at the third position for example, the operator may loosen the first fixing device and then pivot the saw unit to the first position. The saw unit may be fixed in the first position by re-tightening the first fixing device. In order to perform another cutting operation with the saw unit positioned subsequently at the third position, the operator may loosen the first fixing device and pivot the saw unit toward the third position. When the saw unit reaches the third position, the position determining member may contact with the other of the pivotal base and the support base, determining the position of the saw unit at the third position. Therefore, the determination of the position of the saw unit at the third position can be repeatedly and accurately performed.

In order to perform a cutting operation with the saw unit at the second position, subsequent to a cutting operation at the third position, the operator may loosen the second fixing device to enable the rotation of the intermediate member relative to both the pivotal base and the support base. Therefore, the determination of the third position may be cancelled, allowing the saw unit to be pivoted from the third position to the second position.

In this way, the third position can be determined by fixing the intermediate position of the saw unit positioned at the target position, i.e., the third position, and with the position determining member contacting with the other of the pivotal base and the support base. Once the third position has been determined, the saw unit can be repeatedly and accurately positioned at the third position from the first position or from another position on the side of the first position. Therefore, oblique cutting-operations can be quickly preformed with the saw unit accurately positioned at a variety of inclined positions.

In one embodiment, the second fixing device includes a guide slot and a fixing screw. The guide slot is formed in the intermediate base and is elongated about the rotational axis of the pivotal base. The fixing screw is inserted into the guide slot and engages with the pivotal base so that the intermediate base can be fixed in position relative to the pivotal base by tightening the fixing screw. The position determining member contacts the pivotal base when the saw unit has pivoted to the third position.

With this arrangement, by tightening the fixing screw, the intermediate base may be fixed in position at any rotational position within a movable range of the fixing screw relative to the guide slot. Therefore, the determination of the third position of the saw unit may be easily and reliably made by pivoting the saw unit to the third position, rotating the intermediate base until the fixing screw contacts with the pivotal base, and tightening the fixing screw so as to fix the intermediate base in position relative to the pivotal base.

In another embodiment, the position determining member is an adjustable screw engaging with the intermediate base. The adjustable screw has an axial end for contacting with the pivotal base, so that rotating the adjusting screw varies the position of the axial end of the adjusting screw relative to the intermediate base. Therefore, fine adjustment of the third position can be made by rotating the adjustable screw in one direction or an opposite direction in order to change the position of the axial end of the adjusting screw relative to the intermediate base.

In another aspect of the present teachings, obliquely inclined position determining mechanisms for cutting devices are taught. The obliquely inclined position determining mechanisms include a fixed obliquely inclined position determining mechanism and an intermediate obliquely inclined position determining mechanism. The fixed obliquely inclined position determining mechanism serves to limit the pivotal movement of the pivotal base relative to the support base, so that the position of the saw unit can be determined at a plurality of positions including at least a first position and a second position. The intermediate obliquely inclined position determining mechanism serves to determine the pivotal position of the saw unit at a third position between the fist and second positions. The intermediate obliquely inclined position determining mechanism is operable to make fine adjustments to the third position.

Therefore, it is not necessary for the operator to directly move the saw unit in one direction or an opposite direction in order to accurately determine the third position. As a result, the third position can be relatively rapidly and easily determined.

In one embodiment, the intermediate obliquely inclined position determining mechanism includes an intermediate base that is rotatable, relative to both the support base and the pivotal base, about the rotational axis of the pivotal base. A second fixing device is operable to fix the intermediate base in position relative to the support base. A pivotal block is pivotally mounted to the intermediate block so that the pivotal block can pivot about an axis parallel to the rotational axis of the pivotal base. An adjusting screw is coupled to the pivotal base such that the adjusting screw is not axially movable. However, the adjusting screw can rotate relative to the pivotal base. The adjusting screw engages with the pivotal block, so that rotating the adjusting screw varies the position of the intermediate base relative to the pivotal base in order to make fine adjustments of the third position.

With this arrangement, the position of the saw unit may be determined at the first position, e.g., a vertical position, or the second position, e.g., a 45° inclined position, by the fixed obliquely inclined position determining mechanism. Consequently the operator may pivot the saw unit to the first position or the second position with the first fixing device and the second fixing device, i.e., the fixing screws, loosened. In order to determine a position of the saw unit at a third position, the operator may pivot the saw unit after loosening the first and second fixing devices. When the saw unit has pivoted to the third position, the operator may tighten the fixing screw of the second fixing device so that the intermediate base may be fixed in position relative to the support base. With this operation, the third position can be rapidly approximately determined. In order to make fine adjustments to the third position, the operator may rotate the adjusting screw so that the third position may be adjusted in a direction toward the first position or the second position in response to the rotational direction of the adjusting screw.

Therefore, the fine adjustment of the third position can be relatively easily and accurately performed in comparison with a conventional adjusting operation that requires the operator to directly pivot the saw unit by small angle increments.

In a further aspect of the present teachings, cutting devices are taught that include a saw unit having a saw blade, a table for placing a workpiece thereon, and a pivotal support for laterally pivotally supporting the saw unit relative to the table. The pivotal support includes a support base and a pivotal base rotatably coupled to the support base about a rotational axis. A first fixing device is operable to releasably fix the pivotal base in position relative to the support base. A first obliquely inclined position determining mechanism serves to determine an obliquely inclined position of the saw unit. The obliquely inclined position determining mechanism includes an intermediate base, a second fixing device, and an adjusting screw. The intermediate base is rotatable, relative to both the support base and the pivotal base, about the rotational axis of the pivotal base. The second fixing device is operable to releasably fix the intermediate base in position relative to one of the support base and the pivotal base. The adjustable screw is operable to determine the rotational position of the intermediate base relative to the other of the support base and the pivotal base at least when the saw unit has pivoted to a target obliquely inclined position.

In one embodiment, the adjustable screw has a threaded shank engaged with the intermediate base, so that the adjusting screw is operable to determine the rotational position of the intermediate base relative to the other of the support base and the pivotal base. The adjustable screw has an axial end that contacts with the other of the support base and the pivotal base in the rotational direction when the saw unit has pivoted to the target obliquely inclined position.

In another embodiment, the intermediate base has a rotary member rotatably mounted to the intermediate base about an axis parallel to the rotational axis of the intermediate base. The adjustable screw engages with the rotary member in a substantially diametrical direction of the rotary member, so that the adjustable screw can pivot about the axis of the rotary member. The adjustable screw is axially restricted and rotatably supported on the other of the support base and the pivotal base so that the rotational position of the intermediate base relative to the other of the support base and the pivotal base can be varied in response to the rotation of the adjustable screw.

DETAILED DESCRIPTION OF THE INVENTION

Each of the additional features and teachings disclosed above and below may be utilized separately or in conjunction with other features and teachings to provide improved obliquely inclined position determining mechanisms and cutting devices having such mechanisms. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

FIRST REPRESENTATIVE EMBODIMENT

Figure 1:
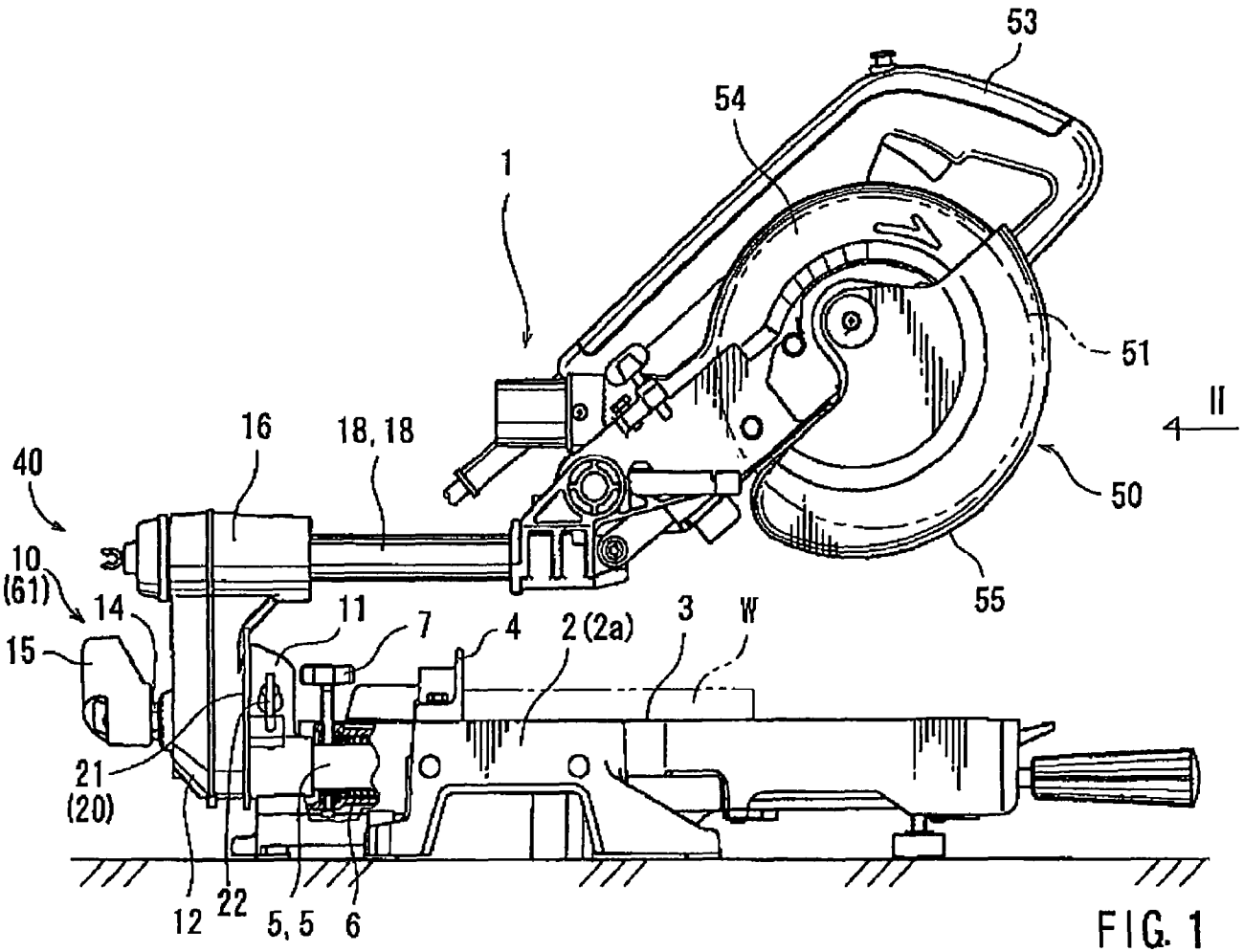
FIG. 1 is a side view of a cutting device incorporating an intermediate inclined position determining mechanism according to a first representative embodiment.
Figure 2:
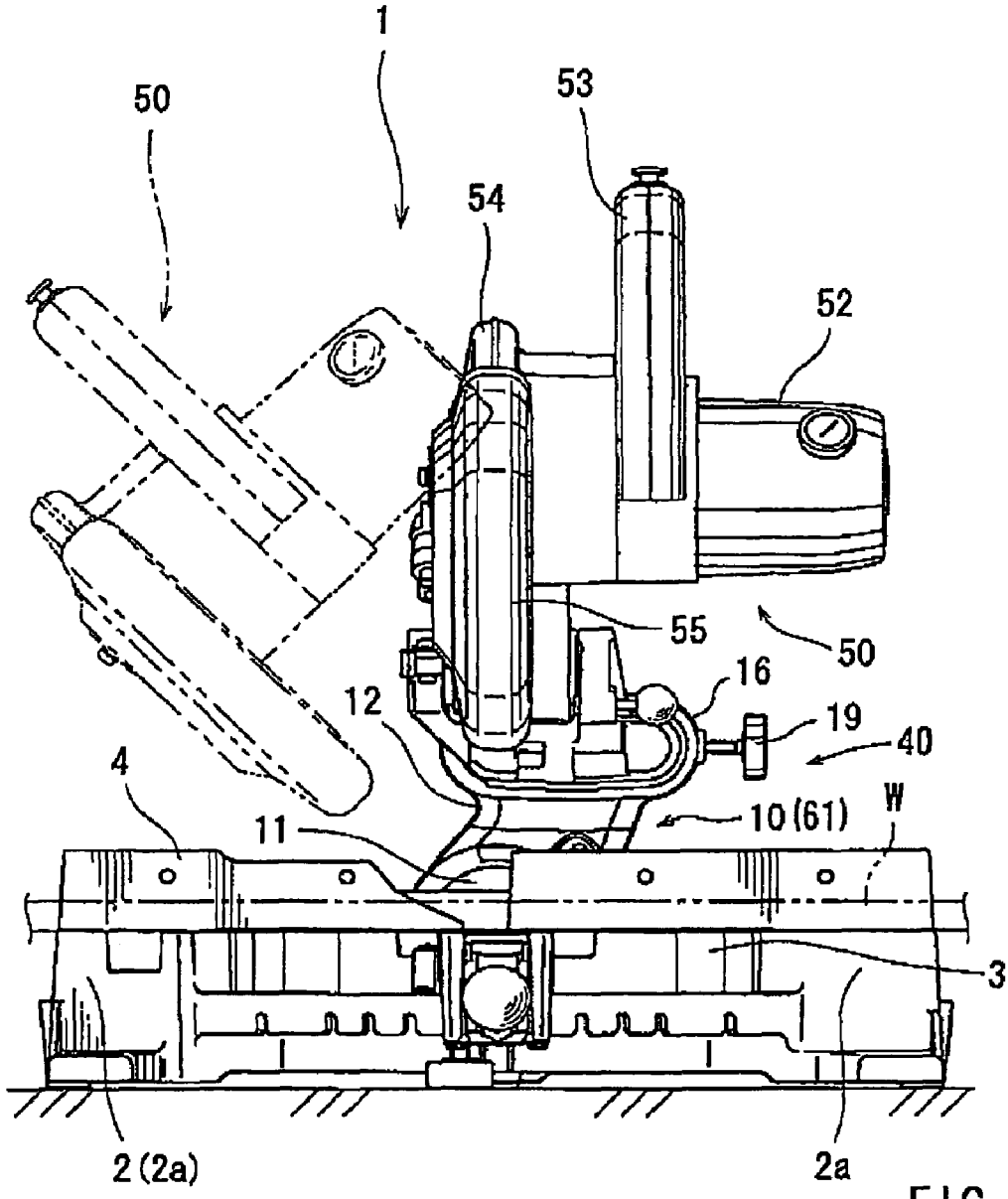
FIG. 2 is a front view of the cutting device as viewed in the direction indicated by an arrow (2) in FIG. 1.

A first representative embodiment of the present invention will now be described with reference to FIGS. 1 to 9. Referring to FIGS. 1 and 2, a cutting device 1 having a representative obliquely inclined position determining mechanism 40 is shown. The cutting device 1 is configured as a table saw and generally includes a base 2, a turntable 3 rotatably supported on the base 2, and a saw unit 50 mounted to the turntable 3 and positioned above the turntable 3. A workpiece W may be placed on the turntable 3 and may be fixed in position by a clamp device (not shown). As shown in FIG. 2, two platforms 2*a* are disposed on the base 2 and are respectively positioned on the right and left sides of the turntable 3. A fence 4 is mounted to the platforms 2*a* so as to extend over the turntable 3 and serves to determine the position of the workpiece W. The upper surface 3 and the upper surfaces of the platforms 2*a* extend substantially within the same horizontal plane.

A pivotal support 10 is mounted to a rear portion (i.e., the left portion as viewed in FIG. 1) of the turntable 3 via a pair of parallel slide bars 5 that are respectively horizontally slidably supported by the turntable 3 by means of bearings 6. The position of the slide bars 5 can be fixed by tightening a fixing screw 7 disposed on the rear portion of the turntable 3.

A slide support 16 is integrated with the upper portion of the pivotal support 10. A pair of upper parallel slide bars 18 is axially slidably supported by the slide support 16 via bearings 17 (see FIG. 5). A fixing screw 19 is mounted to a lateral side of the slide support 16 so that the upper slide bars 18 can be fixed in position by tightening the fixing screw 19 (see FIG. 2). The saw unit 50 is vertically pivotally mounted to front end portions of the upper slide bars 18.

The saw unit 50 has a circular saw blade 51, a motor 52 for driving the saw blade 51, and a handle 53 that may be grasped by the operator for moving the saw unit 50 (primarily in the vertical direction and in the forward and rearward directions) during a cutting operation. The saw unit also has a blade case 54 for substantially covering the upper half of the saw blade 51. A safety cover 55 is mounted to the saw unit 50 in order to cover and uncover the lower half of the saw blade 51 in response to the vertical pivotal movement of the saw unit 50.

Figure 3:
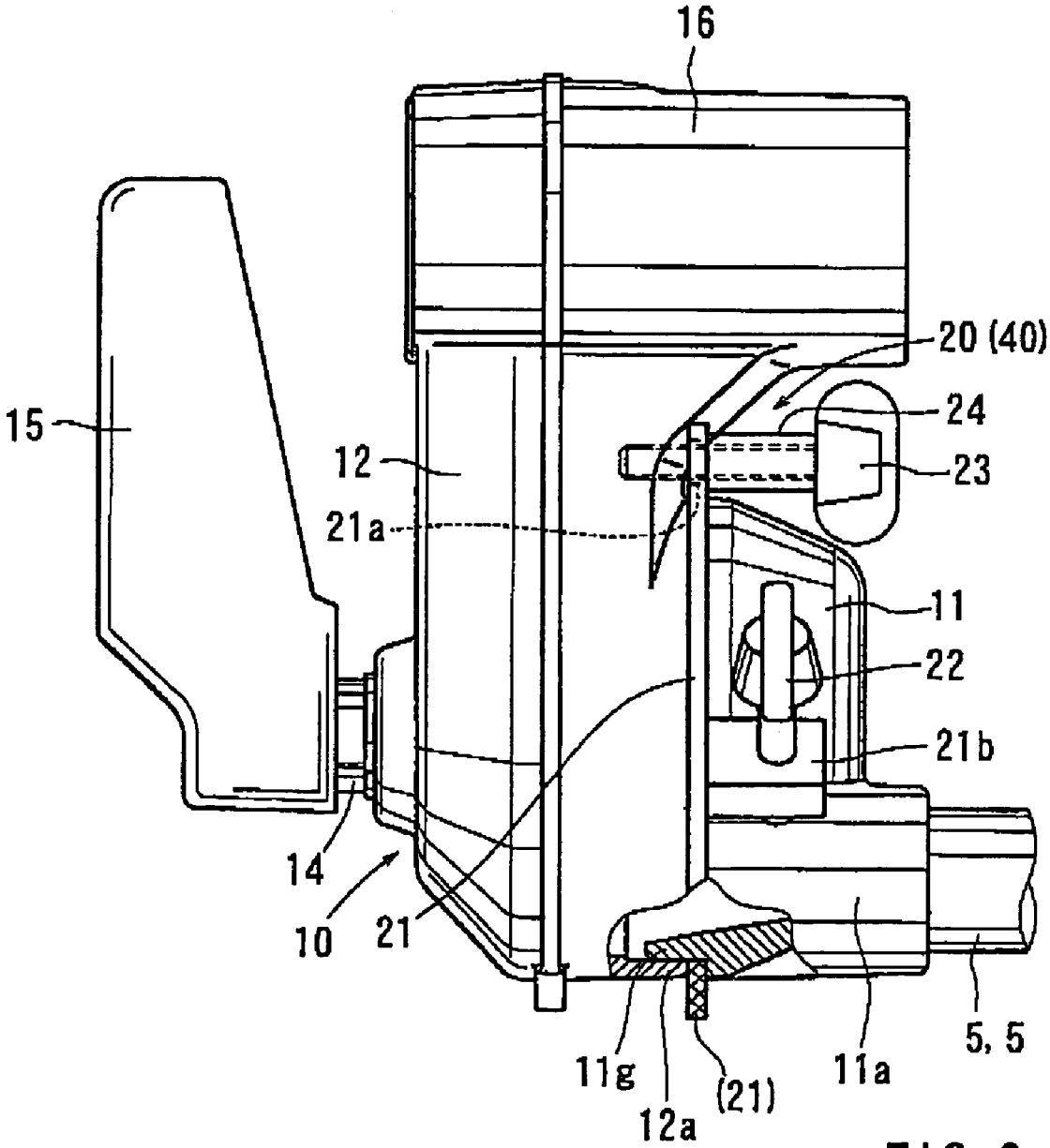
FIG. 3 is a side view of the intermediate inclined position determining mechanism and also showing a pivotal support of the cutting device.
Figure 4:
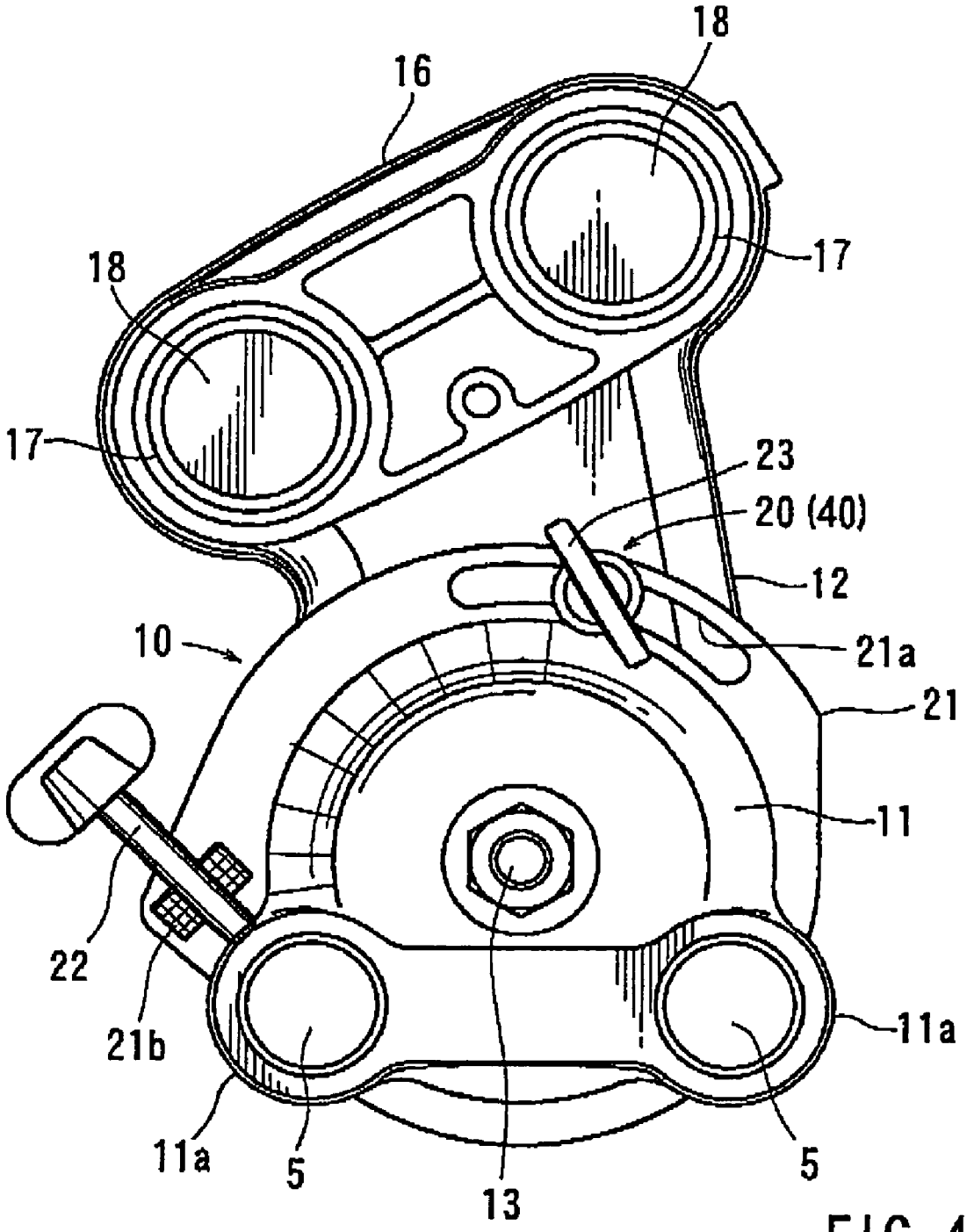
FIG. 4 is a front view of the intermediate inclined position determining mechanism and the pivotal support.
Figure 5:
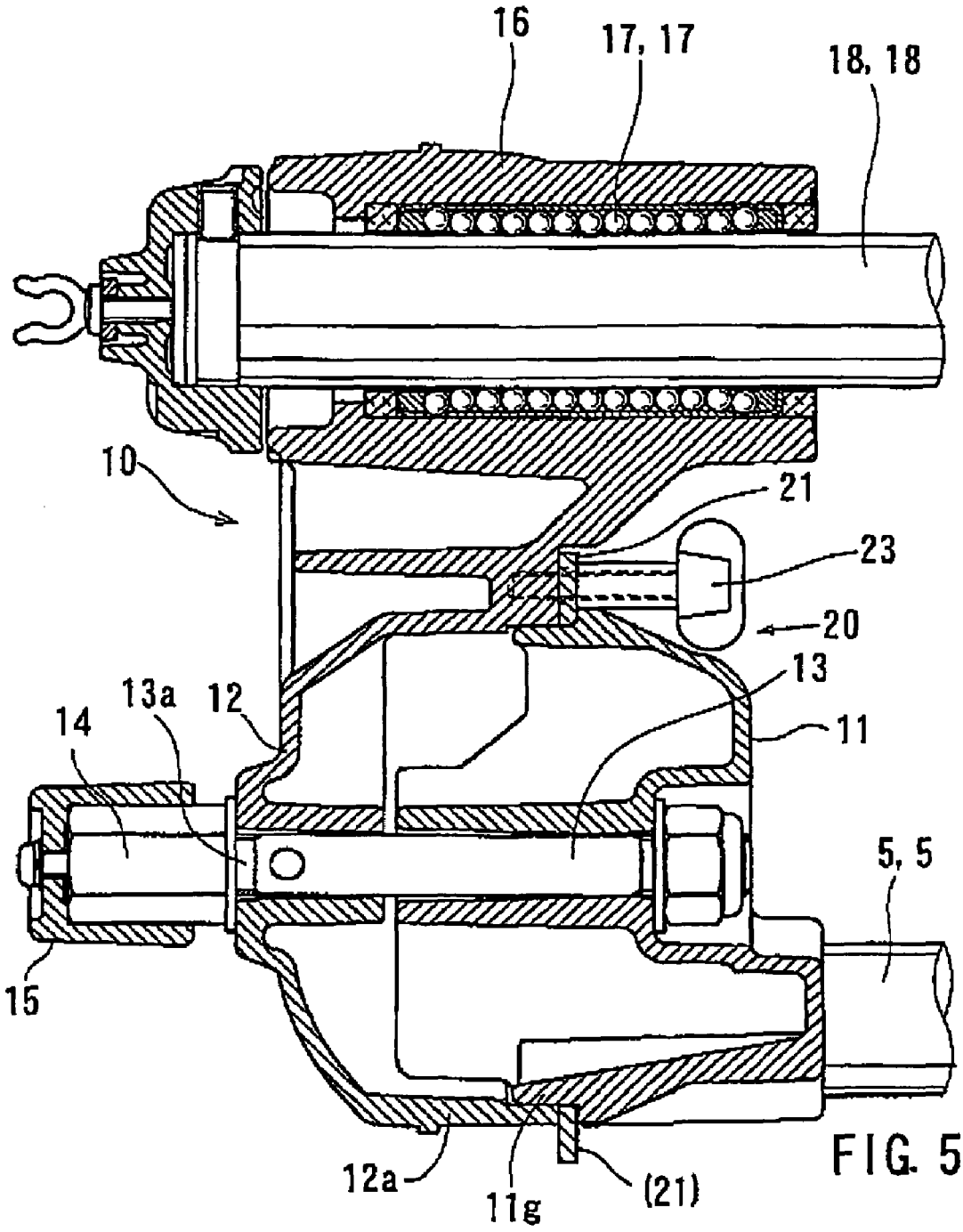
FIG. 5 is a vertical sectional view of the pivotal support with a fixed inclined position determining mechanism eliminated for the purpose of illustration.

The saw unit 50 is laterally pivotally mounted to the rear portion of the turntable 3 via the pivotal support 10 so that the saw unit 50 can pivot in the right and left directions (as an example of the left direction pivot, see chain lines in FIG. 2), with respect to the cutting direction (i.e., the horizontal direction is the cutting direction as viewed in FIG. 1). As shown in FIGS. 3 and 4, an obliquely inclined position determining mechanism 40 is assembled within the pivotal support 10 and includes a fixed inclined position determining mechanism 30 and an intermediate obliquely inclined position determining mechanism 20. The fixed inclined position determining mechanism 30 (see FIG. 6) is operable to determine the position of the saw unit 50 at a substantially vertical position (hereinafter also called a 0° position) with respect to the upper surface of the turntable 3 and ±45° inclined positions (hereinafter also called fixed inclined positions) relative to the vertical position. The intermediate obliquely inclined position determining mechanism 20 is operable to determine the position of the saw unit 50 at a position between the vertical position and the fixed inclined positions. FIG. 5 shows an internal structure of the pivotal support 10. However, for the purposes of illustration, the fixed inclined position determining mechanism 30 is not shown in FIG. 5 but is shown in detail in FIG. 6.

As shown in FIG. 5, the pivotal support 10 includes a support base 11 on the side of the turntable 3 and a pivot base 12 on the side of the saw unit 50. The support base 11 is fixedly mounted to the lower slide bars 5. The pivotal base 12 is laterally pivotally coupled to the support base 11. More specifically, a pivotal shaft 13 extends through and between the support base 11 and the pivotal base 12 so that the pivotal base 12 can pivot laterally, relative to the support base 11, about the pivotal shaft 13. As shown in FIG. 5, the support base 11 and the pivotal base 12 have substantially cup-shaped configurations and respectively have opposing circular open ends 11*g* and 12*a* that are fitted to each other so as to be rotatable relative to each other about the pivotal shaft 13.

The fixing lever 15 is mounted to the rear end (i.e., the left end as viewed in FIG. 5) of the pivotal shaft 13 via a lock nut 14 that is threadably engaged with a male threaded portion 13*a*, formed on the rear end of the pivotal shaft 13. When the fixing lever 15 is rotated in one direction, the lock nut 14 rotates in a loosening direction relative to the male threaded portion 13*a* so that the pivotal base 12 is permitted to freely pivot relative to the support base 11. Conversely, when the fixing lever 15 is rotated in an opposite direction, the lock nut 14 rotates in the tightening direction relative to the male threaded portion 13*a*. As a result, the pivotal base 12 can be fixed in position so as to not pivot relative to the support base 11.

The construction of the fixed inclined position determining mechanism 30 may be substantially the same as the known fixed inclined position determining mechanisms. The fixed inclined position determining mechanism 30 is operable to determine the position of the saw unit 50 at the vertical position and the ±45° inclined positions, where the saw unit 50 has been respectively pivoted in a left direction B (counterclockwise direction) and in a right direction A (clockwise direction) as viewed in FIG. 6.

Figure 6:
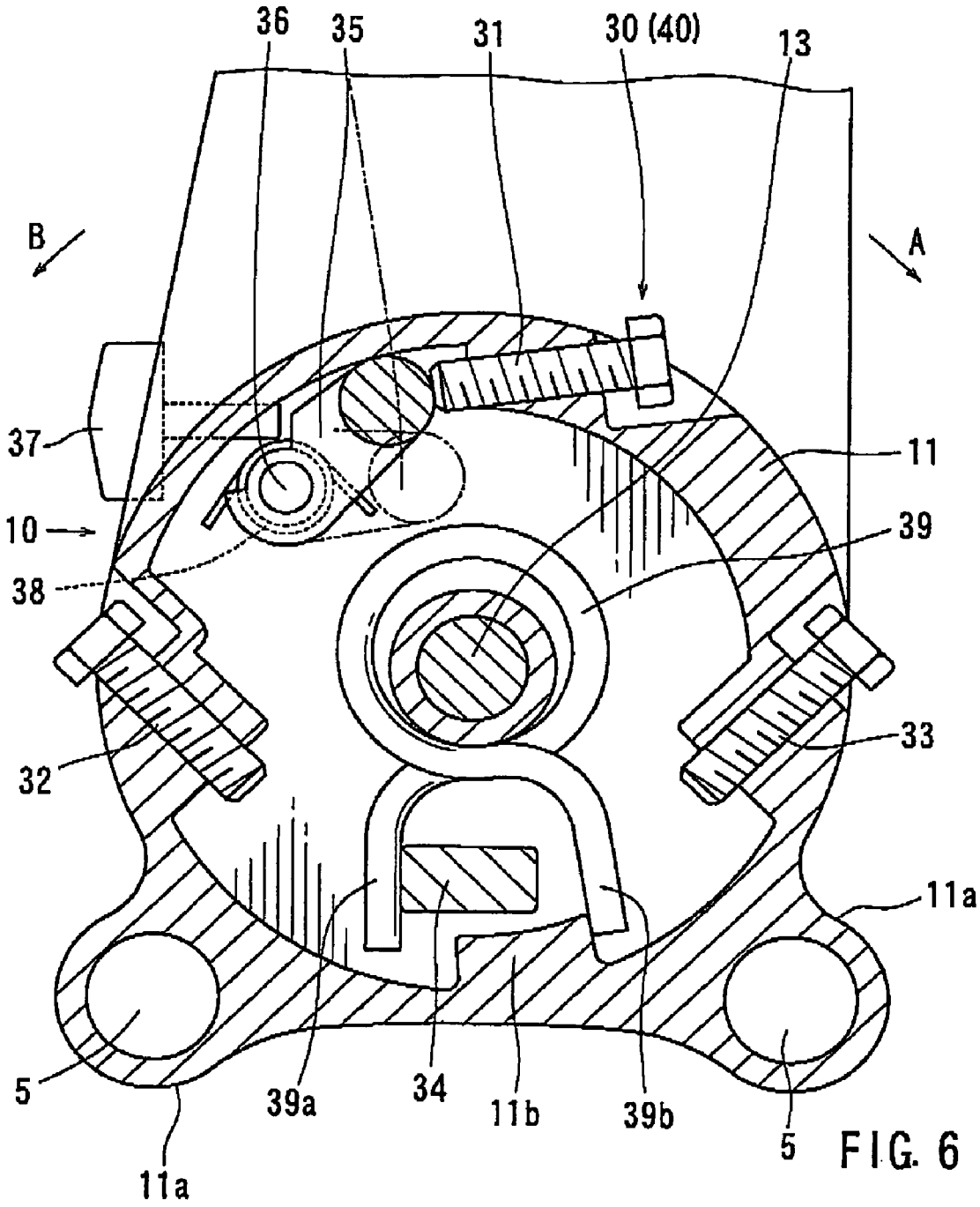
FIG. 6 is a front view of the fixed inclined position determining mechanism.

As shown in FIG. 6, the fixed inclined position determining mechanism 30 may have three stopper bolts 31, 32, and 33, on the side of the support base 11, and a stopper projection 34 on the side of the pivotal base 12. The stopper bolts 31, 32, and 33, are engaged with the support base 11 and are positioned substantially equally spaced from each other in the circumferential direction about the pivotal shaft 13. More specifically, each of the stopper bolts 31, 32, and 33, is engaged with the support base 11 in a direction corresponding to a chord of a circle about the pivotal shaft 13. As a result, each of the stopper bolts 31, 32, and 33 extends from the outer side to the inner side of the circumference of the support base 11. Therefore, end portions of the stopper bolts 31, 32, and 33, extend into the interior space defined within the support base 11, while the heads of the stopper bolts 31, 32, and 33, are exposed to the exterior of the support base 11 for adjustment of the threaded amount of the stopper bolts 31, 32, and 33.

As shown in FIG. 6, the stopper projection 34 projects at a position located between the lower two stopper bolts 32 and 33 in the circumferential direction. The stopper projection 34 extends from the lower portion of the inner wall of the pivotal base 12 into the interior space of the support base 11. When the saw unit 50 is in a vertical position, the stopper projection 34 may be positioned at a substantially middle position between the lower two stopper bolts 32 and 33. When the saw unit 50 has pivoted by an angle of 45° in the left direction as viewed from the side of the operator who operates the table saw (i.e., the direction indicated by the arrow B in FIG. 6, which shows the fixed inclined position determining mechanism 30 as viewed from the side of the operator), the stopper projection 34 may contact with the axial end of the stopper bolt 33 that is positioned on the right side, as viewed in FIG. 6. Therefore, the saw unit 50 can be positioned at the left side 45° inclined position. Conversely, when the saw unit 50 has pivoted by an angle of 45° in the right direction as viewed from the side of the operator who operates the table saw (i.e., the direction indicated by the arrow A in FIG. 6), the stopper projection 34 may contact with the axial end of the stopper bolt 32 that is positioned on the left side, as viewed in FIG. 6. Therefore, the saw unit 50 can be positioned at the right side 45° inclined position. The saw unit 50 may be fixed at the left and right side 45° inclined positions by tightening the fixing lever 15. In addition, fine adjustments of the left side and right side 45° inclined positions can be performed by varying the threaded amounts of the stopper bolts 32 and 33 into the support base 11 (i.e., by rotating the stopper bolts in a clockwise or counterclockwise direction).

A switch block 35 is mounted to the inner wall of the pivotal base 12 and is operable to contact with the axial end of the upper stopper bolt 31 when the saw unit 50 is in a vertical position, as shown in FIG. 6. The switch block 35 is vertically pivotally mounted to a support shaft 36 that extends horizontally from the inner wall of the pivotal base 12 so that the switch block 35 can pivot between a lock position indicated by solid lines in FIG. 6 and an unlock position indicated by chain lines. A torsion coil spring 38 is fitted on the support shaft 36 in order to bias the switch block 35 toward a lock position. An operation button 37 is mounted to the pivotal base 12 and is axially shiftable to pivot the switch block 35 from the lock position to an unlock position against the biasing force of the torsion coil spring 38 as the operator pushes or depresses the operation button 37. When the operator releases the pushing force applied to the operation button 37, the switch block 35 may return to the lock position due to the biasing force of the torsion coil spring 38.

As described above, the switch block 35 is held in the lock position shown in FIG. 6 as long as the operation button 37 is not being depressed. Therefore, the switch block 35 may contact with the axial end of the upper stopper bolt 31 in order to determine the vertical position of the saw unit 50. Also, the saw unit 50 may be fixed at vertical position by tightening the fixing lever 15. An operator can perform fine adjustment of the vertical position by varying the threaded amount of the stopper bolt 31.

With the switch block 35 positioned at a lock position or in other words, with the operation button 37 not operated, it is possible to pivot the saw unit 50 between the vertical position (where the switch block 35 contacts with the stopper bolt 31) and the left side 45° inclined position (where the stopper projection 34 contacts with the stopper bolt 33) by loosening the fixing lever 15.

Conversely, when the operation button 37 is pushed so as to pivot the switch block 35 from the lock position to an unlock position, it is possible to pivot the saw unit 50 rightward as viewed from the side of the operator. Thus, the saw unit 50 may be pivoted rightward until it reaches the right side 45° inclined position, where the stopper projection 34 contacts with the stopper bolt 32.

As shown in FIG. 6, a torsion coil spring 39 is fitted around the pivotal shaft 13 and has opposite ends 39*a* and 39*b*. Between the opposite ends 39*a* and 39*b* is positioned an engaging projection 11*b*. The engaging projection 11*b* is formed on an inner circumferential wall of the support base 11. The stopper projection 34 is also positioned between the opposite ends 39*a* and 39*b* of the torsion coil spring 39. Therefore, when the saw unit 50 pivots in the right or left directions, one of the opposite ends 39*a* and 39*b* is forced to move in the pivoting direction, while the other of the opposite ends 39*a* and 39*b* engages with the engaging projection 11*b*. As a result, the torsion coil spring 39 produces a biasing force opposing the pivotal movement of the saw unit 50 so as to maintain a vertical position of the saw unit 50.

Although not shown in FIGS. 1 to 6, an angular scale may be attached to the upper surface of the support base 11. A pointer may be attached to the outer periphery of the pivot base 12 proximally to the open end of the pivot base 12. Therefore, an operator can recognize the laterally pivoted angle of the saw unit 50 from reading the angular scale at the position indicated by the pointer.

The intermediate obliquely inclined position determining mechanism 20 for enabling the determination of an intermediate obliquely inclined position between the vertical position and the right side or left side 45° inclined position is detailed in FIGS. 3 and 4. As shown in FIGS. 3 and 4, the intermediate obliquely inclined position determining mechanism 20 has a substantially annular intermediate base 21. The intermediate base 21 is slidably fitted on the outer periphery of the open end 11*g* of the support base 11 with no significant radial clearance, provided between the intermediate base 21 and the open end 11*g*. In addition, the intermediate base 21 is interleaved between the open end 11*g* of the support base 11 and the open end 12*a* of the pivotal base 12. No significant amount of axial clearance is provided between the intermediate base 21 and each of the open end 11*g* and the open end 12*a*, although the intermediate base 21 can rotate relative to each of the open end 11*g* and the open end 12*a*. With this arrangement, the intermediate base 21 can rotate about the support shaft 13 relative to both the support base 11 and the pivotal base 12.

The outer portion of the intermediate base 21 extends radially outward beyond the outer peripheral surfaces of the support base 11 and the pivotal base 12. A guide slot 21*a* is formed in an extended upper portion and is configured as an elongated slot in a direction along an arc of a circle about the support shaft 13 within a predetermined angle. A fixing screw 23 has a threaded shank that is inserted into the guide slot 21*a* and is engaged with a corresponding threaded hole formed in the front surface of the pivotal base 12. A sleeve 24 is slidably fitted on the shank of the fixing screw 23 so as to be positioned between the head of the fixing screw 23 and the intermediate base 21. The sleeve 24 has an outer diameter greater than the width of the guide slot 21*a* so that the intermediate base 21 may be fixed in position relative to the pivotal base 12 via the sleeve 24 by tightening the fixing screw 23.

Loosening the fixing screw 23 enables the intermediate base 21 to rotate relative to the pivotal base 12 within a movable range limited to the movement of the shank of the fixing screw 23 within the guide slot 21*a*. Therefore, the rotational position of the intermediate base 21 relative to the pivotal base 12 can be selectively determined within this movable range.

A support block 21*b* is mounted to or formed on a part of the extended outer portion of the intermediate base 21 and is positioned to be displaced from the guide slot 21*a* in the left direction (counterclockwise direction) as viewed in FIG. 4. A stopper screw 22 is threadably engaged with the support block 21*b* and extends therethrough. The axial end of the stopper screw 22 is oriented toward a side surface of one of substantially cylindrical tubular portions 11*a* of a holder 11*b* disposed on the left side as viewed from the side of an operator. The cylindrical tubular portions 11*a* respectively support the rear portions of the slide bars 5.

Therefore, when the saw unit 50 is pivoted to the left side with the intermediate base 21 fixed in position relative to the pivotal base 12 by tightening the fixing screw 23, the axial end of the stopper screw 22 may contact with the side surface of the left side tubular portion 11*a* and thereby inhibit further pivoting of the saw unit 50. As a result, it is possible to easily determine the position of the saw unit 50 at any position inclined by an angle smaller than 45° or at any position between the vertical position and the left side 45° inclined position.

According to the obliquely inclined position determining mechanism 40 described above, it is possible to determine a position at fixed positions, including the vertical position and the right side and left side 45° inclined positions, via the fixed inclined position determining mechanism 30. In addition, it is possible to repeatedly and accurately determine the position where the saw unit 50 is inclined by an angle smaller tan 45°.

For example, in order to move the saw unit 50 from the vertical position to the left side 45° inclined position, the operator may first loosen the fixing lever 15 associated with the fixed obliquely inclined position determining mechanism 30, enabling the pivotal movement of the pivotal base 12 relative to the support base 11. At the same time, the operator may loosen the fixing screw 23 associated with the intermediate obliquely inclined position determining mechanism 20 for enabling free rotation of the intermediate base 21 relative to the pivotal base 12 and the support base 11. The operator may then press the push button 37 for moving the switch block 35 from the lock position to an unlock position. With the push button 37 depressed, the operator may pivot the saw unit 50 rightward as viewed from the side of the operator until the stopper projection 34 contacts the stopper bolt 32. Therefore, the saw unit 50 may be positioned at the right side 45° inclined position. With the position of the saw unit 50 thus determined at the right side 45° inclined position, the operator may tighten the fixing lever 15 so that the saw unit 50 may be fixed in position at the right side 45° inclined position. In order to move the saw unit 50 from a vertical position to the left side 45° inclined position, the operator may first loosen the fixing lever 15 and then the operator may pivot the saw unit 50 until the stopper projection 34 contacts the stopper bolt 33. Thereafter, the operator may tighten the fixing lever 15, so that the saw unit 50 may be fixed in position at the left side 45° inclined position.

In order to position the saw unit 50 at a position where the saw unit 50 is inclined by an angle smaller than an angle of 45°, such as an angle of 30° in the left direction from the vertical position, the operator may first loosen the fixing lever 15 to enable the pivotal movement of the pivotal base 12 relative to the support base 11. In this state, the operator may manually pivot the saw unit 50 to a target inclined angle by referencing the angle on the angular scale indicated by the pointer in the same manner as in the known angular position adjusting operation.

With the saw unit 50 held at the target inclined angle, e.g., an angle of 30°, the operator may rotate the intermediate base 21 until the axial end of the stopper screw 22 contacts with the side surface of one of the tubular portions 11*a*. The operator may tighten the fixing screw 23, so that the intermediate base 21 can then be fixed in position relative to the pivotal base 12. In this state, it is possible to accurately make a relatively fine adjustment of the inclined position of the saw unit 50 about the target angle by rotating the stopper screw 22 in one direction or an opposite direction (i.e., a tightening direction or a loosening direction). Thereafter, the operator may tighten the fixing lever 15, so that the saw unit 50 may be fixed in position at the small angle inclined position, e.g., the left side 30° inclined position.

If the operator wishes to perform another cutting operation with the saw unit 50 positioned at a vertical position after a cutting operation with the saw unit 50 positioned at the left side 30° inclined position, the operator may first loosen the fixing lever 15. The operator may then pivot the saw unit 50 until the switch block 35 contacts with the stopper bolt 31, so that the saw unit 50 can be positioned at a vertical position. The saw unit 50 may then be fixed in position at the vertical position by tightening the fixing lever 15.

However, if the operator wishes to perform yet another cutting operation with the saw unit 50 positioned at the left side 30° inclined position, after the cutting operation with the saw unit 50 positioned at the vertical position, the operator may first loosen the fixing lever 15. The operator may then pivot the saw unit 50 leftward until the stopper screw 22 contacts with the side surface of one of the cylindrical tubular portions 11*a*, so that the saw unit 50 can be positioned at the left side 30° inclined position. The saw unit 50 may then be fixed in position at this position by tightening the fixing lever 15.

In this way, after the rotational position of the intermediate base 21 has been initially set (determined) at the small angle inclined position, the saw unit 50 can be repeatedly and accurately re-positioned at the small angle inclined position.

In order to change the set angle of the small angle pivoted (inclined) position, the operator may first loosen the firing lever 15 for enabling the saw unit 50 to laterally pivot. In addition, the operator may loosen the fixing screw 23 so as to enable free rotation of the intermediate base 21 relative to the pivotal base 12. The operator may then pivot the saw unit 50 to the target inclined angle and may rotate the intermediate base 21 until the stopper screw 22 contacts with the side surface of one of the cylindrical tubular portions 11*a*. The operator next tightens the fixing screw 23 in order to fix the intermediate base 21 in position relative to the pivotal base 12. At this point, it is possible to make fine adjustments of the set angle by rotating the stopper screw 22 in one direction or an opposite direction, so that the set angle may be accurately adjusted to coincide with the target angle. After that, with the saw unit 50 held at the set angle, the operator may tighten the fixing lever 15 in order to fix the position of the saw unit 50 at the small angle inclined position. In this way, the small angle inclined position may be changed to the different target angle. In addition, the small angle inclined position can be varied within a predetermined angular range as defined by the guide slot 21*a*.

As described above, the intermediate obliquely inclined position determining mechanism 20 enables an operator to easily, repeatedly, and accurately, determine the inclined position of a small angle inclined position between the vertical position and one of the fixed inclined positions (the left side 45° inclined position in this representative embodiment) by fixing the rotational position of the intermediate base 21 relative to the pivotal base 12. Therefore, the saw unit 50 can be rapidly prepared for an oblique cutting operation with the saw unit 50 positioned at the small angle inclined position, while the saw unit 50 is positioned at a fixed inclined position. In addition, changing the rotational position of the intermediate base 21 relative to the pivotal base 12 can easily change the set angle. Consequently, the representative cutting device 1 is also improved in operability and the versatility.

The first representative embodiment may be modified in various ways. For example, although the stopper screw 22 is disposed on the left side of the intermediate base 21 as viewed from the side of the operator, the stopper screw 22 may be disposed on the right side of the intermediate base 21. It is also possible to dispose stopper screws 22 on both sides of the intermediate base 21. The axial end of the stopper screw 22 disposed on the right side of the intermediate base 21 may contact with the outer surface of the cylindrical tubular portion 11*a* of the holder 11*b* disposed on the right side as viewed in FIG. 4, so that the position of the saw unit 50 can be determined at a right side small angle inclined position.

In addition, although the first representative embodiment is configured to enable fine adjustment of the small angle inclined position by rotating the stopper screw 22, the stopper screw 22 may be replaced with a pin or a projection that may be mounted to or formed on the intermediate base 21.

Further, the fixed inclined angle may not be limited to the angle of ±45°, but instead may be any other angle combination, such as an angle of ±30°, or +45° −30°, for example.

Furthermore, although the fixing screw 23 fixes the intermediate base 21 to the pivotal base 12, the fixing screw 23 may fix the pivotal base 12 to the intermediate base 21. In such a case, a portion of the pivotal base 11 may contact the fixing screw 23 in order to determine the small angle inclined position.

SECOND REPRESENTATIVE EMBODIMENT

A second representative embodiment will now be described with reference to FIGS. 7 to 9. The second representative embodiment is a modification of the fist representative embodiment and is different from the fist representative embodiment only in that the intermediate obliquely inclined position determining mechanism 20 is replaced with a fine adjusting mechanism 60. The second representative embodiment incorporates a fixed obliquely incline position determining mechanism that is the same as the fixed obliquely inclined position determining mechanism 30. Therefore, like members are given the same reference numbers as in the first representative embodiment and a description of these members may not be repeated.

Figure 7:
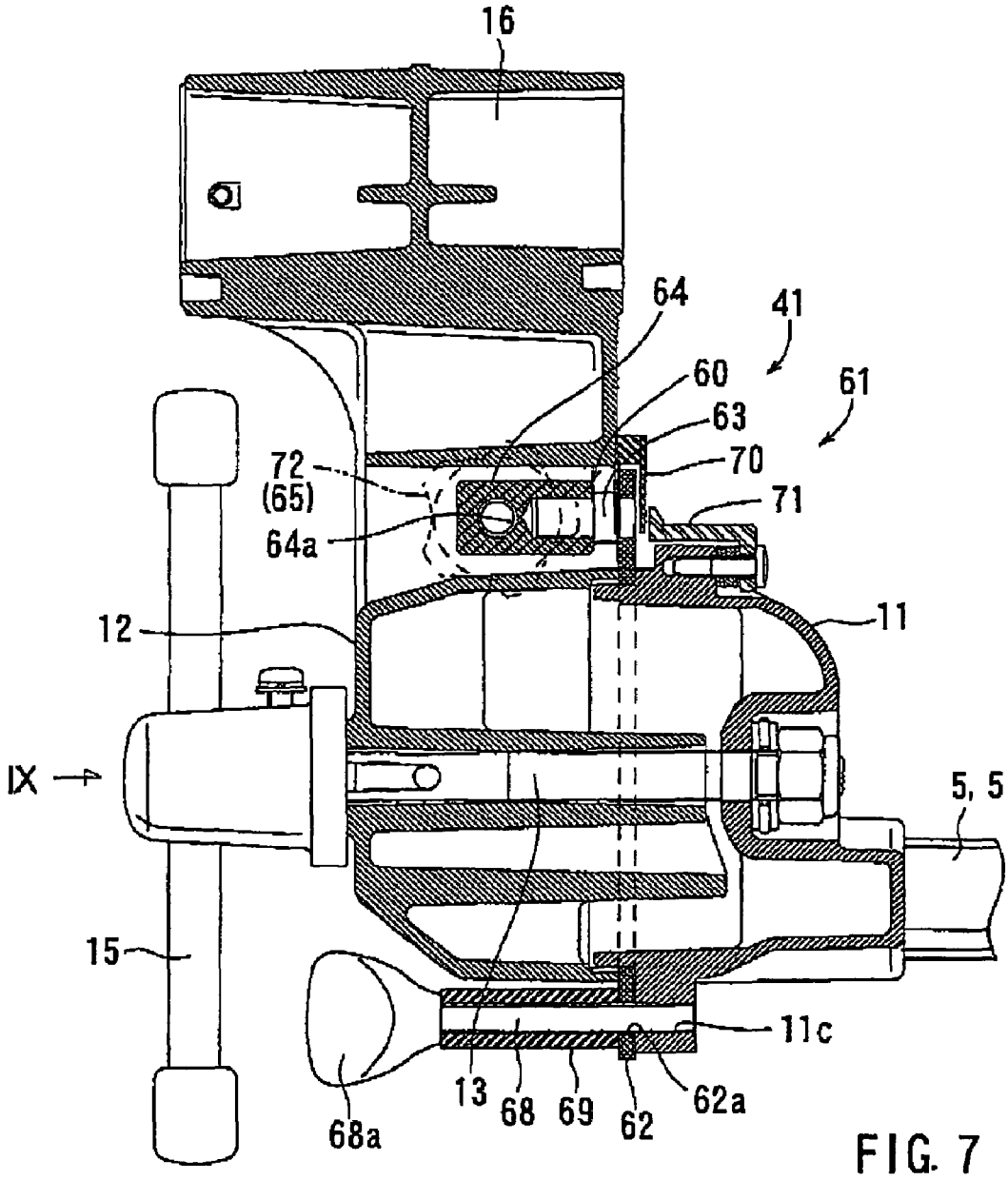
FIG. 7 is a vertical sectional view of a pivotal support of a cutting device incorporating an intermediate inclined position determining mechanism according to a second representative embodiment.
Figure 8:
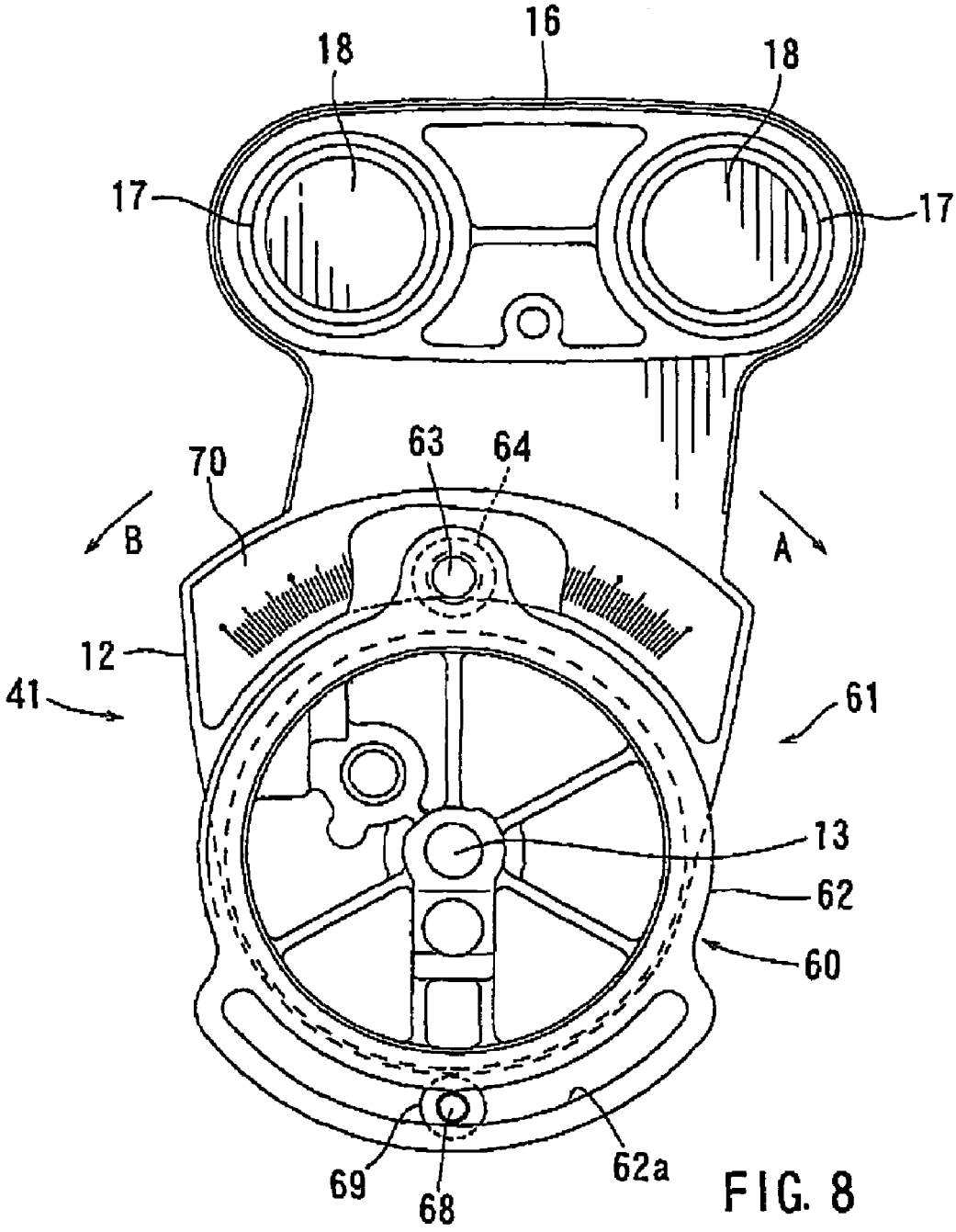
FIG. 8 is a front view of the pivotal support and the intermediate inclined position determining mechanism shown in FIG. 7.
Figure 9:
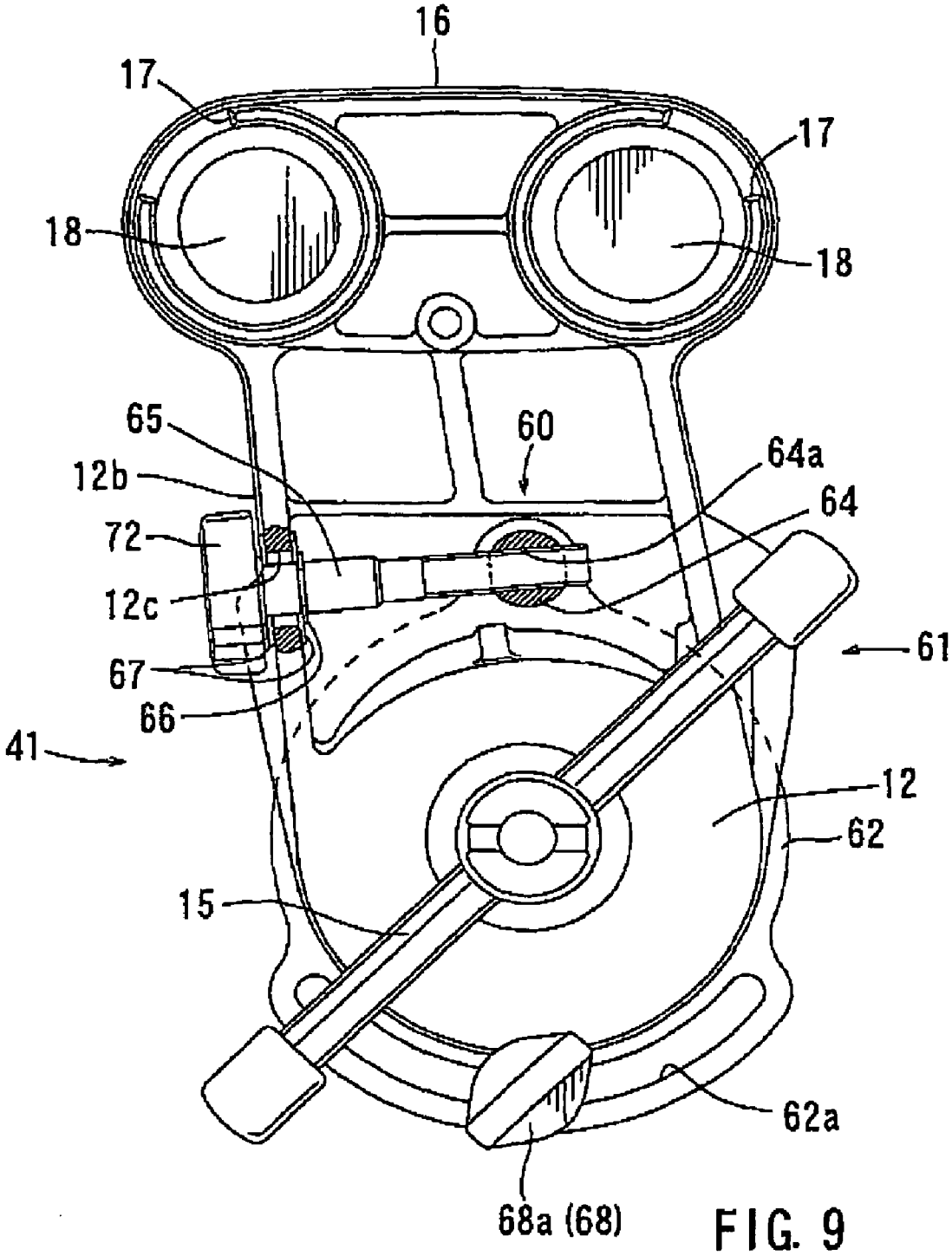
FIG. 9 is a mar view of the pivotal support and the intermediate inclined position determining mechanism shown in FIG. 7 as viewed in the direction of arrow (9) in FIG. 7.

Referring to FIGS. 7 to 9, a second representative obliquely inclined position determining mechanism 41 includes the fine adjusting mechanism 60 in addition to the fixed obliquely inclined position determining mechanism 30 (not shown in FIGS. 7 to 9). The fine adjusting mechanism 60 is assembled to a pivotal support 61, which corresponds to the pivotal support 10 of the first representative embodiment, and includes the support base 11 on the side of the turntable 3 and the pivotal base 12 on the side of the saw unit 50*a*. In addition, an intermediate base 62 is disposed between the support base 11 and the pivotal base 12. The intermediate base 62 is rotatable but is fixed in position in the axial direction relative to the support base 11 and the pivotal base 12. Similar to the intermediate base 21 of the first representative embodiment, the intermediate base 62 has a substantially annular configuration. As shown in FIG. 8, a substantially cylindrical rotatable block 64 is mounted to the upper portion of the intermediate base 62 by via a pin 63, so that the rotatable block 64 can rotate about the pin 63. A threaded hole 64*a* is formed in the rotatable block 64 and extends there through in a diametrical direction. An end portion of a shank of a fine adjusting screw 65 is threadably engaged with the threaded hole 64*a* A guide slot 62*a* having a configuration of an arc of a circle about the support shaft 13 is formed in the lower portion of the intermediate base 62.

As shown in FIG. 9, the shank of the fine adjusting screw 65 is inserted into an insertion hole 12*c* formed in a wall portion 12*b* of the pivotal base 12 and is engaged with the threaded hole 64*a*, so that the head of the fine adjusting screw 65 is positioned so as to extend rightward from the pivotal base 12 as viewed from the side of the operator (to the left as viewed in FIG. 9). A large diameter knob 72 is mounted to the head of the fine adjusting screw 65 in order to facilitate the operator's rotation of the fine adjusting screw 65. Washers 67 are respectively interleaved between the head of the fine adjusting screw 65 and the outer surface of the wall portion 12*b* and between an intermediate large diameter portion of the shank of the fine adjusting screw 65 and an inner surface of the wall portion 12*b*, so that the washers 67 are positioned on opposite sides of the wall portion 12*b*. In addition, a stopper ring 66 is attached to the shank of the fine adjusting screw 65 so as to be interleaved between the intermediate large diameter portion of the shank of the fine adjusting screw 65 and the corresponding washer 66. Therefore, the fine adjusting screw 65 is rotatable but is not movable in an axial direction relative to the wall portion 12*b*. In addition, the diameter of the insertion hole 12*c* is set to be sufficiently larger than the diameter of the shank of the fine adjusting screw 65 in order to permit pivotal movement of the fine adjusting screw 65 within a predetermined range in the radial direction.

On the condition that the intermediate base 62 is fixed in position relative to the support base 11 as will be described later, when the fine adjusting screw 65 configured as described above is rotated in a tightening direction with respect to the threaded hole 64*a* of the rotatable block 64, the pivotal base 12 and eventually the saw unit 50 may laterally pivot in the clockwise direction as viewed in FIG. 9 (a direction indicated by an arrow B in FIG. 8), because the fine adjusting screw 65 is fixed in position in the axial direction relative to the wall portion 12*b* of pivotal base 12. Conversely, when the fine adjusting screw 65 is rotated in a loosening direction with respect to the threaded hole 64*a*, the saw unit 50 may laterally pivot in the counterclockwise direction as viewed in FIG. 9 (a direction indicated by an arrow A in FIG. 8). Therefore, the fine adjustment of a small angle inclined position of the saw unit 50 can be readily made. The pivoted angle may vary in response to the amount of rotation of the fine adjusting screw 65. Alternatively, the adjusting screw 65 may be axially restrained and rotatably supported on the support base 11 instead of pivotal base 12.

An end portion of a shank of a fixing screw 68 is inserted into the guide hole 62*a* of the intermediate base 62 and is threadably engaged with a threaded hole 11*c* formed in the lower portion of the support base 11. A sleeve 69 is fitted on the shank of the fixing screw 68. A large diameter knob 68*a* is mounted to the head of the fixing screw 68 in order to facilitate the rotational operation of the fixing screw 68. Therefore, when the operator tightens the fixing screw 68, the lower portion of the intermediate base 62 may be clamped between the sleeve 69 and the support base 11 so that the intermediate base 62 can be fixed in position relative to the support base 11. When the fixing screw 69 is loosened, the intermediate base 62 may be permitted to rotate relative to the support base 11 within the movable range of the fixing screw 68 within the guide slot 62*a*.

As shown in FIG. 8, an angular scale 70, for the indication of the inclined angle, is attached to the upper portion of the front surface (as viewed from the side of the operator) of the pivotal base 12. Conversely, a pointer 71 is mounted to the upper portion of the support base 11 and is used for pointing to the angular scale 70. Therefore, an operator can recognize the actual inclined angle of the saw unit 50 from reading the angular value indicated by the pointer 71 on the angular scale 70 during the pivoting operation of the saw unit 50 from the vertical position to either the right side or the left side pivoted position.

By using the fine adjusting mechanism 60 of this second representative embodiment, the small angle inclined position of the saw unit 50 may be easily and accurately determined between the vertical position and the left side or right side fixed inclined position (the left side or right side 45° inclined position in this representative embodiment) according to the following operations:

The operator may initially rotate the fixing lever 15 in the loosening direction in order to enable the pivotal movement of the pivotal base 12 relative to the support base 11. At the same time, the operator may loosen the fixing screw 68 in order to enable rotation of the intermediate base 62 relative to the support base 11. With these operations, the saw unit 50 may be permitted to freely pivot in the lateral direction. When the operator pivots the saw unit 50 in the left direction as viewed from the side of the operator (the direction indicated by the arrow A in FIG. 8), the stopper projection 34 may contact with the stopper bolt 33 (not shown in FIGS. 7 to 9), so that the saw unit 50 may be positioned at the left side 45° inclined position (i.e., the left side fixed inclined position). The saw unit 50 may then be fixed in this position by rotating the fixing lever 15 in the tightening direction.

Conversely, when the operator pivots the saw unit 50 in the right direction as viewed from the side of the operator (the direction indicated by the arrow B in FIG. 8) while pushing the push button 37 (not shown in FIGS. 7 to 9) after loosening the fixing lever 15 and the fixing screw 68, the stopper projection 34 may contact with the stopper bolt 32 (not shown in FIGS. 7 to 9), so that the saw unit 50 may be positioned at the right side 45° inclined position (i.e., the right side fixed inclined position). The saw unit 50 may then be fixed in this position by rotating the fixing lever 15 in the tightening direction.

When the operator pivots the saw unit 50 from the right side or the left side 45° inclined position toward the vertical position after loosening the fixing lever 15, the switch block 35 in the lock position may contact with the stopper bolt 31 (not shown in FIGS. 7 to 9), so that the saw unit 50 may be positioned at the vertical position. The saw unit 50 may then be fixed in this position by rotating the fixing lever 15 in the tightening direction.

In order to position the saw unit 50 at a small angle inclined position between the vertical position and the right side or the left side 45° inclined position, the operator may first loosen the fixing lever 15 and the fixing screw 68. The loosening enables the pivotal movement of the pivotal base 12 relative to the support base 11 and also enables the rotation of the intermediate base 62 relative to the support base 11. The operator may then pivot the saw unit to the left side or the right side toward a target inclined position while visually recognizing the actual inclined angle from reading the angle indicated by the pointer 71 on the angular scale 70. When the saw unit 50 has pivoted to the target inclined position, the operator may hold the saw unit 50 in this position and may then tighten the fixing screw 68, fixing the intermediate base 62 in position relative to the support base 11. At this point, the fixing lever 15 may be kept in a loosened condition. However, because the intermediate base 62 has been fixed in position relative to the support base 11 by the tightening of the fixing screw 68, the pivotal base 12 may be temporarily indirectly fixed in position relative to the support base 11.

The operator may then rotate the fine adjusting screw 65 to adjust the position of the threaded hole 64*a* of the rotatable block 64 along the fine adjusting screw 65. The pivotal base 12 may then pivot by a small angle relative to the intermediate base 62 and consequently, relative to the support base 11. In this way, it is possible to make fine adjustments of the small angle inclined position of the saw unit 50. By rotating the fine adjusting screw 65 in the tightening direction with respect to the threaded hole 64*a* of the rotatable block 64, the pivotal base 12 and consequently the saw unit 50 may pivot in the direction indicated by the arrow A in FIG. 8. Conversely, by rotating the fine adjusting screw 65 in the loosening direction with respect to the threaded hole 64*a* of the rotatable block 64, the pivotal base 12 and consequently the saw unit 50 may pivot in the direction indicated by the arrow B in FIG. 8. Since the force for pivoting the saw unit 50 is produced by the rotation of the fine adjusting screw 65 relative to the threaded hole 64*a*, the operator can readily move the relatively heavy saw unit 50 via the small operation force required for rotating the fine adjusting screw 65.

After completion of the fine adjustment of the small angle inclined position, the operator may tighten the fixing lever in order to directly fix the pivotal base 12 to the support base 11, so that the saw unit 50 can be accurately positioned at the small angle inclined position. In order to pivot the saw unit from the small angle inclined position to the vertical position or any other position, the operator may loosen the fixing lever 15 and the fixing screw 68. It is not necessary to operate the fine adjusting screw 65.

As described above, with this second representative embodiment the saw unit 50 may also be easily and accurately positioned at a small angle inclined position or an intermediate position between the vertical position and the right side or left side 45° inclined position.

The invention claimed is:

1. A cutting device comprising:

a saw unit having a saw blade, a table for placing a workpiece thereon, a pivotal support for laterally pivotally supporting the saw unit relative to the table, the pivotal support including;

a support base, and a pivotal base rotatably coupled to the support base about a rotational axis;

a first fixing device operable to releasably fix the pivotal base in a position relative to the support base, a first obliquely inclined position determining mechanism arranged and constructed to determine an obliquely inclined position of the saw unit, wherein the first obliquely inclined position determining mechanism comprises:

an intermediate base rotatable about the rotational axis of the pivotal base and rotatable relative to the support base and the pivotal base, a second fixing device operable to releasably fix the intermediate base in a position relative to one of the support base and the pivotal base, and an adjustable screw operable to further determine the rotational position of the intermediate base relative to the other of the support base and the pivotal base at least when the saw unit has pivoted to a target obliquely inclined position.

2. The cutting device as in claim 1, wherein the adjustable screw has a threaded shank engaged with the intermediate base, so that the adjusting screw is operable to further determine the rotational position of the intermediate base relative to the other of the support base and the pivotal base.

3. The cutting device as in claim 2, wherein the adjustable screw has an axial end that contacts with a rotatable block mounted on the intermediate base.

4. The cutting device as in claim 2, wherein the second fixing device is operable to releasably fix the intermediate base in position relative to the pivotal base; and.

5. The cutting device as in claim 2, wherein the intermediate base has a rotary member rotatably mounted to the intermediate base about an axis parallel to the rotational axis of the intermediate base; and wherein the adjustable screw threadably engages with the rotary member in a substantially diametrical direction of the rotary member, so that the adjustable screw can pivot about an axis of the rotary member; and wherein the adjustable screw is axially restrained and rotatably supported on the pivotal base, so that the rotational position of the intermediate base relative to the other of the support base and the pivotal base can be varied in response to rotation of the adjustable screw.

6. The cutting device as in claim 5, wherein the second fixing device releasably fixes the intermediate base in position relative to the support base.

7. The cutting device as in claim 1, further comprising:

an angular scale and a pointer respectively attached to one and the other of the support base and the pivotal base, so that the adjustment of the target inclined position can be made with reference to an angular value of the angular scale as indicated by the pointer.

8. The cutting device as in claim 1, wherein the second fixing device comprises a fixing screw; and wherein the intermediate base has an elongated slot extending along an arc with respect to the rotational axis of the intermediate base; and wherein the fixing screw is inserted into the elongated slot and engages with the one of the support base and the pivotal base.

9. The cutting device as in claim 1, further comprising a second obliquely inclined position determining mechanism arranged and constructed to determine the obliquely inclined position of the saw unit at a plurality of positions including at least a vertical position and a first obliquely inclined position inclined relative to the vertical position; and wherein the saw blade of the saw unit in the vertical position extends substantially perpendicular to a surface of the table;

wherein the first obliquely inclined position determining mechanism is operable to determine the obliquely inclined position between the vertical position and the first obliquely inclined position.

10. The cutting device as in claim 9, wherein the first obliquely inclined position is a 45° inclined position.

11. The cutting device as in claim 10, wherein the plurality of positions determined by the second obliquely inclined position determining mechanism further includes a second obliquely inclined position inclined on the side opposite to the first obliquely inclined position with respect to the vertical position.

12. An obliquely inclined position determining mechanism for a cutting device wherein the cutting device comprises a saw unit having a saw blade, a table for placing a workpiece thereon, a pivotal support for pivotally supporting the saw unit relative to the table, wherein the pivotal support includes a support base on the side of the table and a pivotal base on the side of the saw unit, wherein the pivotal base is rotatably coupled to the support base about a rotational axis, and a first fixing device operable to fix the pivotal base in position relative to the support base, the obliquely inclined position determining mechanism comprising:

a fixed obliquely inclined position determining mechanism arranged and constructed to limit the pivotal movement of the pivotal base relative to the support base, so that the position of the saw unit can be determined at a plurality of positions including at least a first position and a second position; and an intermediate obliquely inclined position determining mechanism arranged and constructed to determine the pivotal position of the saw unit at a third position between the first and second positions, wherein the intermediate obliquely inclined position determining mechanism is operable to make fine adjustments to the third position and comprises:

an intermediate base rotatable relative to the support base and the pivotal base about the rotational axis of the pivotal base;

a second fixing device operable to fix the intermediate base in position relative to the support base;

a pivotal block pivotally mounted to the intermediate base, so that the pivotal block can pivot about an axis parallel to the rotational axis of the pivotal base; and an adjusting screw coupled to the pivotal base such that the adjusting screw is axially restrained and rotatable, relative to the pivotal base, wherein the adjusting screw engages with the pivotal block, so that the position of the intermediate base relative to the pivotal base can be varied by rotating the adjusting screw so as to make fine adjustments of the third position.

* * * * *